US007934350B2

(12) United States Patent
Koutsoukos

(10) Patent No.: US 7,934,350 B2
(45) Date of Patent: May 3, 2011

(54) SECURITY SCREEN

(75) Inventor: Jamie Dimitrios Elias Koutsoukos, East Perth (AU)

(73) Assignee: G & J Koutsoukos Holdings Pty Ltd, Malaga (AU)

( * ) Notice: Subject to any disclaimer, the term of this patent is extended or adjusted under 35 U.S.C. 154(b) by 608 days.

(21) Appl. No.: 11/628,790

(22) PCT Filed: Mar. 24, 2005

(86) PCT No.: PCT/AU2005/000430

§ 371 (c)(1),
(2), (4) Date: Mar. 20, 2007

(87) PCT Pub. No.: WO2005/121486

PCT Pub. Date: Dec. 22, 2005

(65) Prior Publication Data

US 2007/0181273 A1 Aug. 9, 2007

(30) Foreign Application Priority Data

Jun. 14, 2004 (AU) ..... 2004903189

(51) Int. Cl.
*E04C 2/38* (2006.01)

(52) U.S. Cl. ..... 52/656.7; 52/208; 52/291; 52/273; 52/222; 160/378

(58) Field of Classification Search ..... 52/202, 52/204.51, 207, 203, 208, 204.593, 204.6, 52/291, 63, 656.7, 273, 222; 160/369, 371, 160/378, 380, 381, 382, 391, 392, 395, 398, 160/399, 402, 403

See application file for complete search history.

(56) References Cited

U.S. PATENT DOCUMENTS 2,335,361 A * 11/1943 Schiller ..... 160/395

(Continued)

FOREIGN PATENT DOCUMENTS

AU 70345/1994 3/1995

(Continued)

*Primary Examiner* — Eileen Lillis
*Assistant Examiner* — Theodore Adamos
(74) *Attorney, Agent, or Firm* — Gottlieb, Rackman & Reisman, P.C.

(57) ABSTRACT

A security screen comprising a frame having an outer edge which defines the outer perimeter of the frame and further having an inner edge (12) which surrounds an open portion of the frame, the outer edge of the frame being dimensioned such that in use the security screen is receivable across an opening to close the opening, a perforate sheet element (29) received in the open portion of the frame to close the open portion, the edge of the perforate sheet element being formed with a lip (31) extending from one face of the perforate sheet element, the inner edge of the frame formed with a recess (13) having an entry extending across at least a portion of the width of the inner edge, the recess extending along the inner edge, the recess having two opposed side faces (15, 16) extending from the inner edge, one side face (16) of the recess having a zone (23) located inward of the inner edge and extending laterally from the recess, the edge of the perforate sheet element received within the recess such that the lip is located within the zone and the one face of the perforate sheet element adjacent the lip overlies the one side face, a locking member (33) fixed within the recess between the other face of the perforate sheet element and the other side face of the recess to close the space between the perforate sheet element and the other side face.

17 Claims, 2 Drawing Sheets

U.S. PATENT DOCUMENTS

| | | | | |
|---|---|---|---|---|
| 2,588,697 | A * | 3/1952 | Burch | 160/40 |
| 2,783,834 | A * | 3/1957 | Brame | 160/395 |
| 4,878,314 | A * | 11/1989 | Blockinger | 49/381 |
| 6,125,910 | A * | 10/2000 | Pepperell et al. | 160/371 |
| 2005/0056389 | A1 * | 3/2005 | Kelley et al. | 160/371 |

FOREIGN PATENT DOCUMENTS

| | | |
|---|---|---|
| AU | 78780/1998 | 2/1999 |
| AU | 2003244563 | 3/2004 |
| WO | WO 00/73614 | 12/2000 |
| WO | WO 02/12672 | 2/2002 |

* cited by examiner 11
11a
11b
12
13
15
16
17
19
21
23
25
27
29
31
33
37
39
41
- 13 -

SECURITY SCREEN

FIELD OF THE INVENTION

This invention relates to security screens which can take the form of screens which are mounted across windows in order to allow the flow of air past them whilst not unduly restricting the vision through the doorway, preventing the entry of insects into a building and preventing unauthorised access through the window. Other examples of such screens comprise screen doors which are used in association with externally facing doorways in order to allow the flow of air past them whilst not unduly restricting the vision through the doorway, preventing the entry of insects into a building and preventing unauthorised access through the doorway. An example of such a screen is disclosed in the specification of Australian patent 742820.

DISCLOSURE OF THE INVENTION

Accordingly, the invention resides in a security screen comprising a frame having an outer edge which defines the outer perimeter of the frame and further having an inner edge which surrounds an open portion of the frame, the outer edge of the frame being dimensioned such that in use the security screen is receivable across an opening to close the opening, a perforate sheet element being dimensioned to be received in the open portion of the frame to close the open portion, the edge of the perforate sheet element being formed with a lip extending transversely from one face of the perforate sheet element, the inner edge of the frame formed with a recess having an entry extending across at least a portion of the width of the inner edge, the recess extending along the inner edge, the recess having two opposed side faces each extending from the inner edge, the inner portion of the recess having an zone which extends transversely from the one side face in opposed relation to the other side face, the zone defined at least in part by an outermost side wall which extends transversely from the one side face, the edge of the perforate sheet element received within the recess such that the lip is located within the zone and the one face of the perforate sheet element adjacent the lip overlies the one side face, a locking member fixed within the recess between the other face of the perforate sheet element and the other side face of the recess to close the space between the sheet element and the other side face and to retain the lip within the zone to lie adjacent the outermost side wall which prevents movement of the lip from the zone towards the inner edge.

According to a preferred feature of the invention, the one side face is defined between an abutment which also defines the outermost side wall of the zone and the inner edge of the frame. According to a preferred feature of the invention, the inner edge of the frame is formed with a flange and the one side face is open between the abutment and the flange. According to an alternative preferred feature of the invention, the inner edge of the frame is formed with a flange and the one side face is defined by a web which extends between the abutment and the flange.

According to a preferred feature of the invention, the zone has a width a little greater than the thickness of the sheet material and a depth greater than the extent of the lip form the one face of the sheet element.

1. According to a preferred feature of the invention, the inner extent of the recess is defined by an end wall which defines the inner-most side wall of the zone. According to a preferred feature of the invention the spacing between the inner side wall and the outer side wall in the region of the one side face is less than spacing for the remainder of the zone. According to a preferred feature of the invention, the outer side wall is divergent from the inner-most side wall of the zone from the one side face. According to a preferred feature of the invention, the outer side wall is of a generally concave or recessed configuration.

According to a preferred feature of the invention, the locking member is formed of increasing thickness to enable it in use to be wedgingly engaged between the other side face of the recess and the other face of the perforate sheet element. According to a preferred feature of the invention, the locking member is fixed in the recess at least in part, through the frictional inter-engagement between the locking member and the other side face. According to a preferred feature of the invention, the locking member is fixed in the recess at least in part through the inter-engagement of complementary formations provided on the opposed face of the recess and opposed face of the locking member. According to a preferred feature of the invention, the complementary formations comprise serrated-like formations on the opposed face of the recess and opposed face of the locking member. According to a preferred feature, of the invention the complementary formations comprise corrugated-like configurations on the opposed face of the recess and opposed face of the locking member.

According to a preferred feature of the invention, the retention of the locking member in the recess is supplemented by fixing elements between the locking member and the frame.

According to a preferred feature of the invention, the locking member substantially fills the space defined within the recess between lip and the inner edge, between the other face of the perforate sheet element and the other side face of the recess.

According to a preferred feature of the invention, the perforate sheet element is not clampingly engaged between the locking member and the one side face. According to an alternative preferred feature of the invention the perforate sheet element is clampingly engaged between the locking member and the one side face.

According to a preferred feature of the invention, the perforate sheet element is formed of a non-expanded steel sheet having a thickness sufficient to withstand penetration as a result of impact by blunt objects and having a plurality of closely spaced apertures punched therein which are dimensioned to prevent insect access through the apertures, wherein the spacing of the apertures provides a substantially unrestricted view through the sheet element. According to a preferred feature of the invention, the perforate sheet element is formed of stainless steel sheet. According to an alternative preferred feature of the invention, the perforate sheet element is formed of a woven mesh. According to an alternative preferred feature of the invention, the perforate sheet element is formed of an expanded mesh.

According to a preferred feature of the invention, the lip extends for the full extent of the edge of the perforate sheet element.

According to a preferred feature of the invention, the locking member comprises an elongate member The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENTS

Each of the embodiments are directed to a security screen which may be used in association with a window opening or a doorway. In each case the screen comprises a frame which defines the perimeter of the screen and comprises an upper and lower frame member and lateral side members to define a substantially rectangular space between them. In each case the frame members 11 are formed of an aluminium section comprise a main body section 11*a* and an inner edge portion 11*b*. The rectangular space defined by the frame is closed by a screen element 29 which is supported from the inner portion 11*b* of the frame members. The screen element can be formed of mesh, perforated sheet, expanded metal or the like and is formed of material such that it is resistant to impact by blunt objects in order to provide a security barrier.

Figures 1, 2, 3:
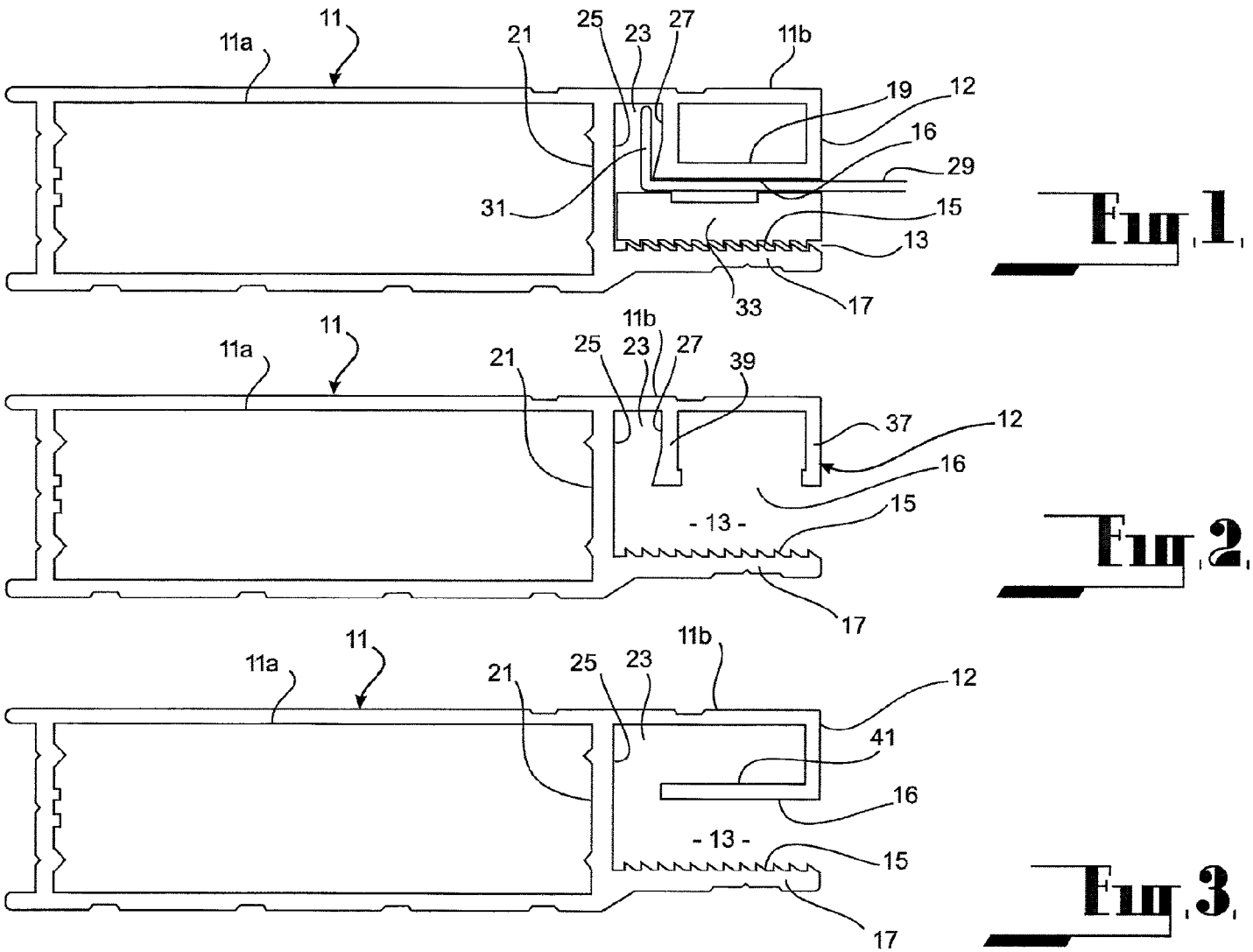
FIG. 1 is a partial cross section of a security screen according to the first embodiment illustrating the frame and a portion of the screen element.
FIG. 2 is across section of a frame according to the second embodiment.
FIG. 3 is a cross section of a frame according to the third embodiment.

In the case of the first embodiment as shown at FIG. 1 the inner portion 11*b* defines a recess 13 which has an open face located along the face of the inner edge 12 of the frame member 11 and which is defined between a pair of opposed side faces 15 and 16 which are in a substantially parallel spaced relation and which extend inwardly into the frame member from the entry. One side face 15 is defined by a box section 19 provided in the inner portion 11*b*. The other side face 16 is provided by a flange 17 of the inner portion 11*b* and has a serrated configuration. The innermost end of the recess is defined by a transverse web 21 which extends between the outer faces of the section 11. The box section 19 terminates short of the web 21 to define a zone 23 which is located inward of the box section and the zone extends between the one side face 16 the recess and the web 21 and therefore the innermost side wall 25 of the zone 23 is defined by the web 21 while the outermost side wall 27 of the recess of the zone 23 is defined by the end most face of the box section 19. The outermost side wall 27 of the zone 23 has a recessed or concave configuration and as a result the entry into the zone adjacent the one side face 16 of the recess is of a reduced width.

As indicated above the edges of the screen element 29 are retained in the recess 13 of the innermost portion 11*b* of the frame 11. To this end the edges of the screen element are provided with a lip 31 which is formed by bending the edges of the screen element in order that the lip 31 is generally perpendicular to the main body of the screen element 29. The width of the lip is such that it will be received through the recess and can be accommodated in the zone 23. Once the lip 31 is engaged in the zone 23, the screen element is retained in position by means of an elongate locking member 33 which is receivable between the other side face 16 of the recess and the opposed face of the screen element 29.

The face of the elongate locking member which is in opposed relation with the other side face 16 of the recess 13 is formed with a serrated formation which is complementary to that of the other side face 16. The complementary serrated formations are such that they will enable insertion of the elongate locking member 33 into the recess 13 but restrict outward movement of the elongate locking member 33 from the recess. The engagement of the elongate locking member 33 with the screen element 29 is such that the screen element is clampingly engaged between the flange 17 and the box section 19.

It is a characteristic of the first embodiment that it simplifies the fixing of a screen element in the frame therefore the manufacture of a security screen.

Furthermore, in addition to the retention of the screen element 29 by the clamping engagement between the elongate locking member 33 and the box section 19 the retention of the screen element is further enhanced by the engagement of the lip 31 against the outer side face 27 of the zone which serves as an abutment which will engage with the root of the lip 31. In order for the screen element to move out of engagement between the elongate locking member 33 and the one side face 16, the lip 31 must be bent to be substantially co-planar with the main body of the screen element and any initial outward movement of the screen element out of the recess 13 will cause the root only of the lip to become engaged against the outer edge of the outer side wall 27. In addition because the zone has a width less than the width of the lip, on deflection of the lip, its outer edge will become engaged with the inner side wall of the zone which will increase the degree of resistance to the further deformation of the lip.

It is a further characteristic of the security screen according to the embodiment that the space between the flange 17 and the screen element is closed by the elongate locking member and no space is provided which will readily allow the entry of the end of a lever which can be used to lever the frame from the screen element.

The second embodiment utilises a section as shown at FIG. 2 which is of a generally the same form as that of the first embodiment with the exception that the box section 19 is replaced by a pair of transverse flanges 37 and 39 where the outermost flange 37 defines entry of the recess 13 and the innermost flange 39 defines the outer side wall of the recess 23. As a result the one side face is open and is defined between the edges of the flanges 37 and 39.

The third embodiment utilises a section as shown at FIG. 3 which is of a similar form to that of the first embodiment with the exception that the innermost face of the box section 19 is open and the other side face 15 is defined by an inwardly extending flange 41.

Figure 4:
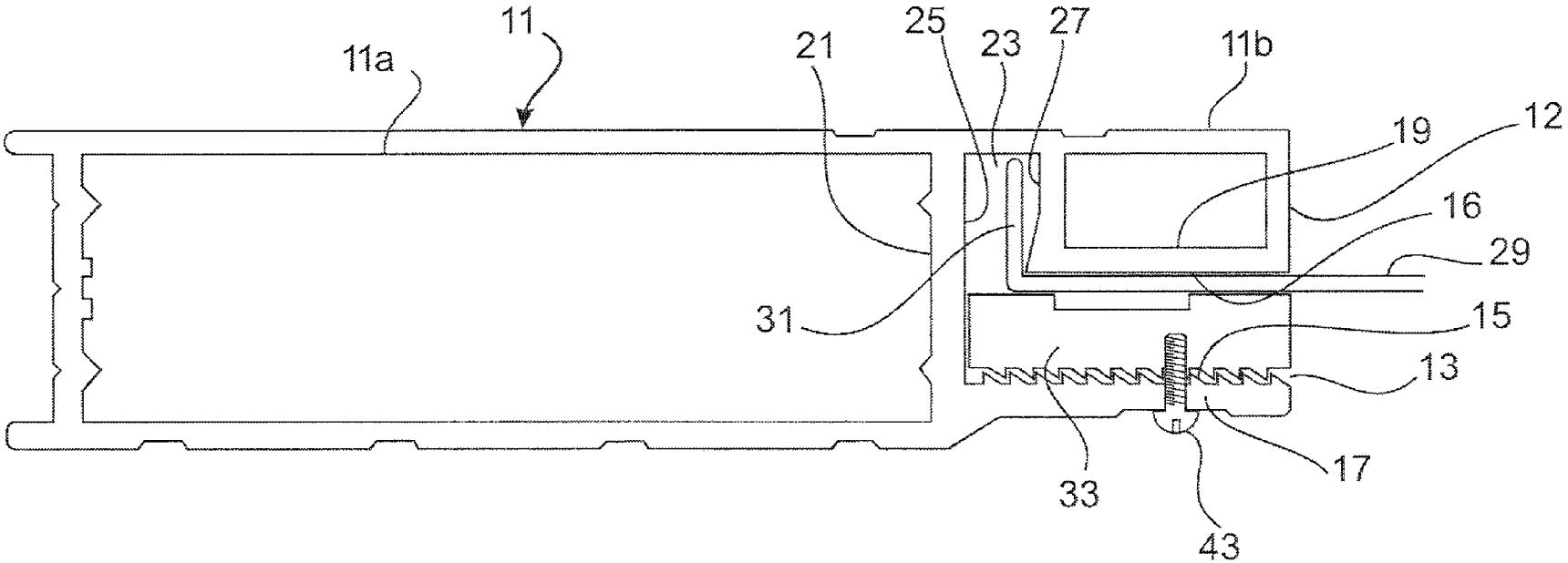
FIG. 4 is a partial cross section of a security screen according to the fourth embodiment, illustrating the frame and a portion of the screen element.

According to a fourth embodiment of the invention and as shown at FIG. 4 screws 43 or like fixing means can be applied at spaced intervals along the inner portion 11*b* between the flange 17 and the elongate locking member 13 to fix the elongate locking member 13 in position.

According to a further embodiment of the invention the edges of the screen element including the lip are covered by a film or layer of an insulating material which serves to prevent metal to metal contact between the screen element and the frame and elongate locking member.

According to a further embodiment the elongate locking member closes the space between the other face and the screen element but does not substantially clampingly engage the screen element against the one side face of the recess.

According to a further embodiment of the invention the serrated surface of the other face has a corrugated or convoluted configuration rather than a serrated configuration and the opposing face of the elongate locking member has a complementary configuration.

According to a further embodiment of the invention the elongate locking member of the first embodiment is replaced by a set of members which can be installed in the frame along the length of the inner edge.

Throughout the specification, unless the context requires otherwise, the word "comprise" or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiment described above.

The invention claimed is:

1. A security screen comprising a frame having an outer edge which defines an outer perimeter of the frame and further having an inner edge which surrounds an open portion of the frame, the outer edge of the frame being dimensioned such that in use the security screen is receivable across an opening to close the opening, a perforate sheet element being dimensioned to be received in the open portion of the frame to close the open portion; the edge of the perforate sheet element being formed with a lip extending transversely from one face of the perforate sheet element, the inner edge of the frame formed with a recess having an entry extending across at least a portion of the width of the inner edge, the recess extending a first length along the inner edge, the recess having two opposed side faces each extending from the inner edge, the inner portion of the recess having a zone which extends transversely from the one side face in opposed relation to the other side face, the other side face comprising a proximal end adjacent the inner edge and a distal end defining said first length therebetween, the zone defined at least in part by an outermost side wall which extends transversely from the one side face, the edge of the perforate sheet element received within the recess such that the lip is located within the zone and the one face of the perforate sheet element adjacent the lip overlies the one side face, a locking member fixed within the recess between the other face of the perforate sheet element and the other side face of the recess to close the space between the perforate sheet element and the other side face and to retain the lip within the zone to lie adjacent the outermost side wall which prevents movement of the lip from the zone towards the inner edge, said locking member comprising a second length substantially equal to the first length and being arranged and configured to clamp the perforate sheet material against the said side face at least in part through the inter-engagement of complementary formations provided on the opposed face of the recess and an opposed face of the locking member, said complementary formations comprising of serrated-like or corrugated-like configurations.

2. A security screen as claimed at claim 1 wherein the one side face is defined between an abutment which also defines the outermost side wall of the zone and at the inner edge of the frame.

3. A security screen as claimed at claim 2 wherein the inner edge of the frame is formed with a flange and the one side face is defined between the abutment and the flange.

4. A security screen as claimed at claim 2 wherein the inner edge of the frame is formed with a flange and the one side face is defined by a web which extends between the abutment and the flange.

5. A security screen as claimed at claim 2 wherein the zone has a width a little greater than the thickness of the sheet material and a depth greater than the extent of the lip form the one face of the perforate sheet element.

6. A security screen as claimed at of claim 2 wherein the inner extent of the recess is defined by an end wall which defines the inner-most side wall of the zone.

7. A security screen as claimed at claim 6 wherein the spacing between the inner side wall and the outer side wall in the region of the one side face is less than a spacing for the remainder of the zone.

8. A security screen as claimed at claim 7 wherein the outer side wall is divergent from the inner-most side wall of the zone from the one side face.

9. A security screen as claimed at claim 7 wherein the outer side wall is of a generally concave or recessed configuration.

10. A security screen as claimed at claim 1 wherein the retention of the locking member in the recess is supplemented by fixing elements between the locking member and the frame.

11. A security screen as claimed at claim 1 wherein the locking member substantially fills the space defined within the recess between lip and the inner edge, between the other face of the perforate sheet element and the other side face of the recess.

12. A security screen as claimed at claim 1 wherein the perforate sheet element is formed of a non-expanded steel sheet having a thickness sufficient to withstand penetration as a result of impact by blunt objects and having a plurality of closely spaced apertures punched therein which are dimensioned to prevent insect access through the apertures, wherein the spacing of the apertures provides a substantially unrestricted view through the perforate sheet element.

13. A security screen as claimed at claim 12 wherein perforate sheet element is formed of stainless steel sheet.

14. A security screen as claimed at claim 12 wherein the perforate sheet element is formed of a woven mesh.

15. A security screen as claimed at claim 12 wherein the perforate sheet element is formed of an expanded mesh.

16. A security screen as claimed at claim 1 wherein the locking member comprises an elongate member.

17. A security screen as claimed at claim 1 wherein the lip extends for the full extent of the edge of the perforate sheet element.

* * * * *